US006276283B1

(12) United States Patent
Weber

(10) Patent No.: US 6,276,283 B1
(45) Date of Patent: Aug. 21, 2001

(54) RAILWAY TRUCK WEAR PLATE

(75) Inventor: Earl K. Weber, Wheaton, IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/287,826

(22) Filed: Apr. 7, 1999

(51) Int. Cl.[7] ..... B61F 15/00
(52) U.S. Cl. ..... 105/225
(58) Field of Search ..... 105/191, 193, 105/198.5, 200, 207, 224.05, 225

(56) References Cited

U.S. PATENT DOCUMENTS

| | | | | |
|---|---|---|---|---|
| 3,834,320 | * | 9/1974 | Tack | 105/197 DB |
| 3,857,341 | | 12/1974 | Neumann | 105/197 DB |
| 4,109,585 | | 8/1978 | Brose | 105/197 DB |
| 4,167,907 | | 9/1979 | Mulcahy et al. | 105/197 DB |
| 4,254,712 | * | 3/1981 | O'Neil | 105/197 |
| 4,254,713 | | 3/1981 | Clafford | 105/197 DB |
| 4,256,041 | | 3/1981 | Kemper et al. | 105/197 DB |
| 4,316,417 | * | 2/1982 | Martin | 105/197 DB |
| 4,539,114 | * | 9/1985 | Mention et al. | 210/330 |
| 4,574,708 | * | 3/1986 | Solomon | 105/193 |
| 4,953,471 | | 9/1990 | Wronkiewicz et al. | 105/198.4 |
| 5,095,823 | | 3/1992 | McKeown, Jr. | 105/198.2 |
| 5,452,665 | | 9/1995 | Wronkiewicz et al. | 105/198.2 |
| 5,921,186 | * | 7/1999 | Hawthorne et al. | 105/207 |

* cited by examiner

*Primary Examiner*—S. Joseph Morano
*Assistant Examiner*—Robert J. McCarry, Jr.
(74) *Attorney, Agent, or Firm*—Edward J. Brosius

(57) ABSTRACT

A wear plate for a side-frame column surface of a railcar truck assembly side frame has corner relief at the corners of the surface in proximity to the bolster and the friction shoe in the friction-shoe pocket, which friction shoe is still operable to damp the harmonic oscillations of the railcar by contact with the surface of the wear plate, but the bolster lands in proximity to the wear plate are protected from harm and wear through indiscriminate contact with a sharp corner of the wear plate.

4 Claims, 3 Drawing Sheets

RAILWAY TRUCK WEAR PLATE

BACKGROUND OF THE INVENTION

Railcar trucks are utilized at the undercarriage of railcars to support and provide the axles and wheels for the railcars. These railcar trucks or truck assemblies generally include a pair of parallel side frames and a bolster between these side frames. Each side frame has a generally centrally positioned portal outlined by a forward column surface, a rearward column surface, a base and a roof portion. The bolster has a first end and a second end, which ends generally have forward and rearward friction shoe pockets. Friction shoes, or snubbers, are operable to damp the oscillation, or frequency of the harmonic roll, of the railcar during its operation.

Within the above-noted portal spring-packs are nested with the bolster outer ends nested thereon for biasing of the bolster. In addition, the snubbers or friction shoes may be biased by a spring within the spring pack. There are various alternative arrangements and structures for biasing snubbers, which include constant and variable damping arrangements.

Friction shoes have a wearing or contacting face for engagement with a side-frame column surface. However, this friction shoe engagement involves metal to metal contact, which involves a wearing condition between the surfaces and potential galling or gouging of one or both surfaces. Metal-to-metal contact usually results in significant wear on the softer material, which in this circumstance may be the column surface . As repair of the column surface or replacement of the side frame are undesirable, difficult and expensive propositions wear plates are frequently mounted on the column surfaces. These wear plates are generally rectangular segment, which are hard or hardened material. The segments are mounted directly on the column surfaces for wearing contact with the snubbers or friction shoes to minimize wear on the side frame columns. As the frictions shoes are smaller segments and subject to wear, they are considered to be more easily replaced.

The mounted wear plates are, as noted, usually rectangular segments, which can potentially gouge or mar the bolster lands adjacent to the friction shoe and friction shoe pocket. Therefore, the present invention provides corner relief, or broken corners, to provide clearance between the wear plate and the bolster lands, while simultaneously providing a wearing surface for the friction shoe.

SUMMARY OF THE INVENTION

The present invention provides a wear plate for a side-frame column surface of a railway truck assembly. The wear plate has corner relief at the corners of the surface in proximity to the bolster and the friction shoe in the friction shoe pocket. In this arrangement, the friction shoe is still operable to damp the harmonic oscillations of the railcar by contact with the surface of the wear plate, but the bolster lands in proximity to the wear plate are protected from harm and wear through indiscriminate contact with a sharp corner of the wear plate.

BRIEF DESCRIPTION OF THE DRAWING

In the several figures of the drawings, like reference numerals identify like components, and in the drawing.

DETAILED DESCRIPTION OF THE PREFERRED EMBODIMENT

Figure 1:
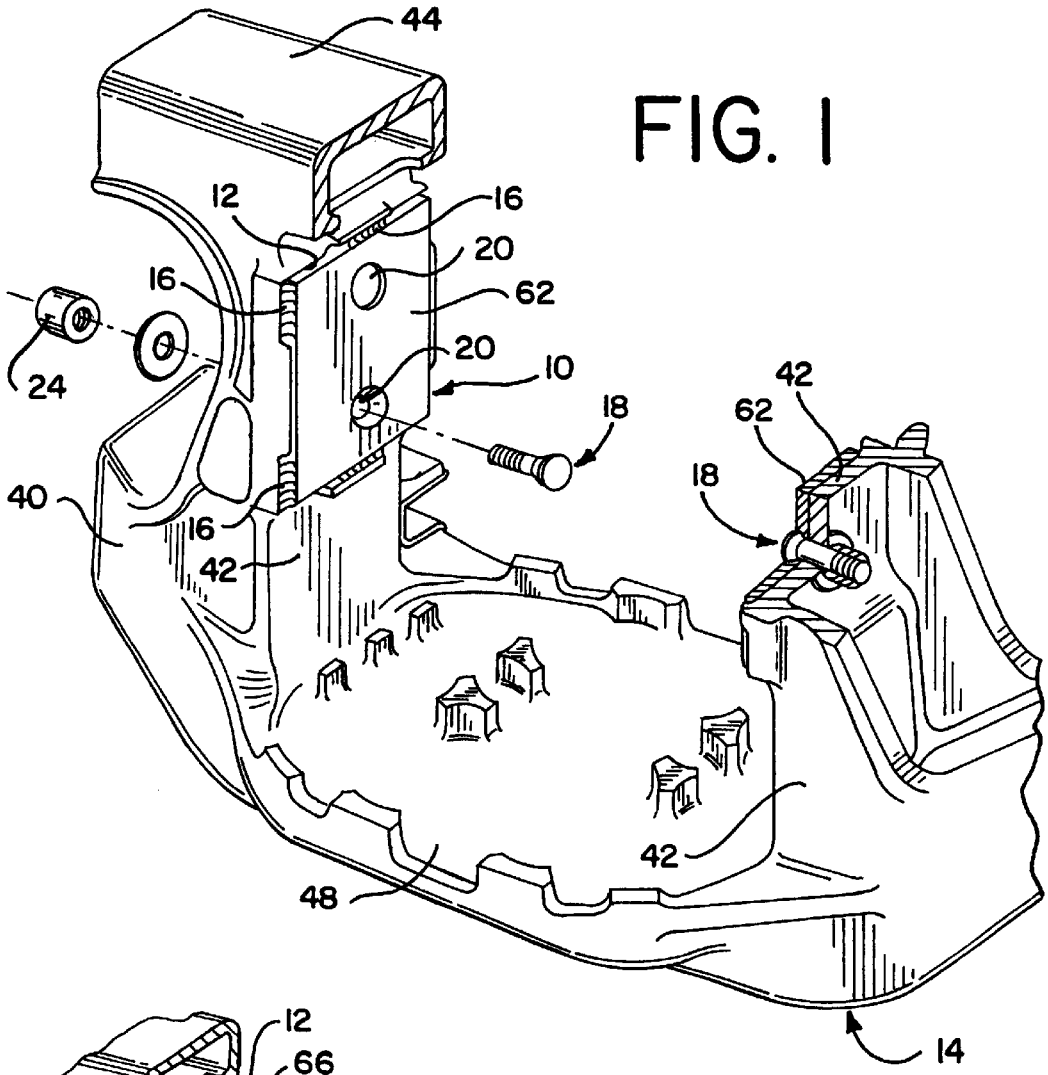
FIG. 1 is a fragmentary side elevational view of a railcar truck side frame.
Figure 2:
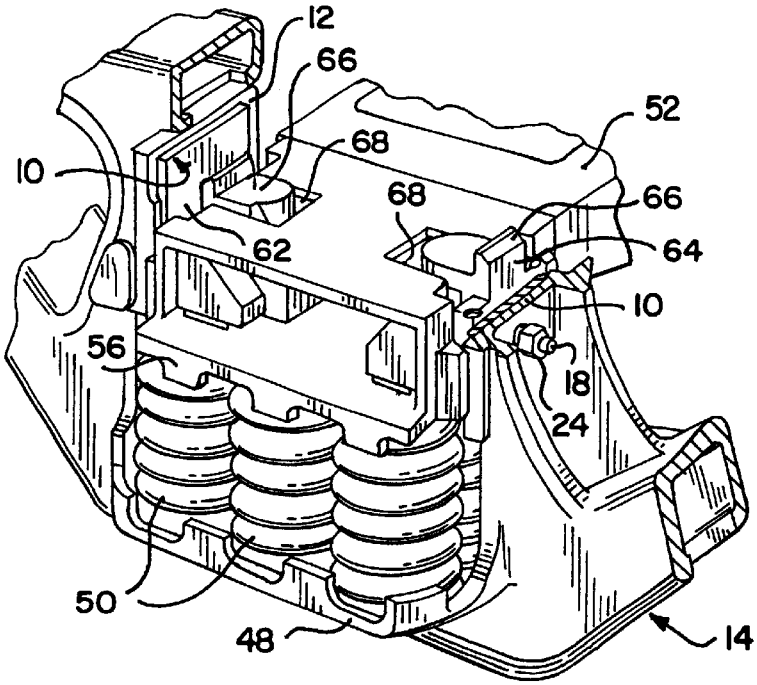
FIG. 2 is a fragmentary perspective view of a railcar truck side frame and bolster from the outbo side with portions of the side frame and bolster broken away.

A wear plate 10 for column surface 12 of a railcar truck side frame 14 is noted in FIG. 1. In FIGS. 1, 2, 4 and 5, wear plate 10 is secured to column surface 12 by weldments 16 and rivets or bolts 18, which bolts 18 extend through wear-plate passages 20 and column surface ports 22 for coupling with nuts 24.

Figure 7:
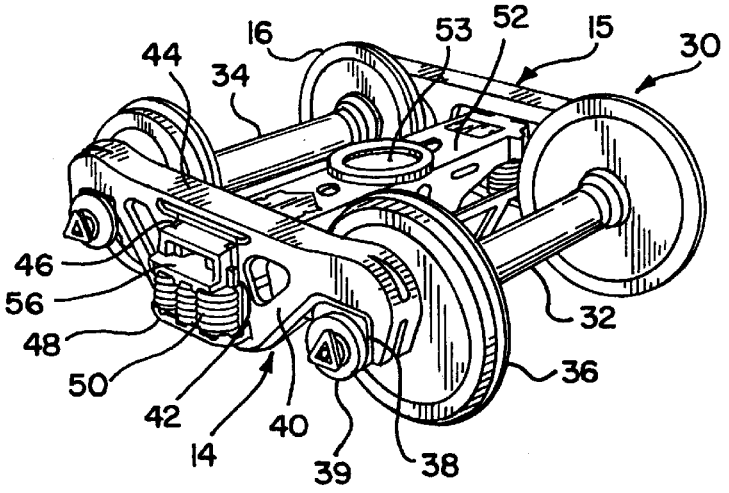

Railcar truck assembly 30 in FIG. 7 has first side frame 14 and second side frame 15 with first axle 32 and second axle 34 extending between pedestal jaws 38 of first and second side frames 14, 15. Wheels 36 are mounted at the ends of each axle 32 and 34 and include roller bearing assemblies 39. Side frames 14, 15 have tension members 40 downwardly extending from pedestal jaw opening 38, and side frame columns 42 extending upwardly from the lower portion of tension members 40 to compression member 44. Side frame columns 42 are generally vertical and form a bolster opening 46 between side frame columns 42. Spring support shelf bottom 48 extends outwardly from the lower section of side frame 14 to receive the bottom end of 54 spring group load coils 50. Bolster 52 with center plate 53 extends between side frames 14, 15 with its bolster ends 56 extending through bolster openings 56 of the respective side frames 14, 15. Center plate 53 receives the car body bolster center plate (not shown).

Figure 3:
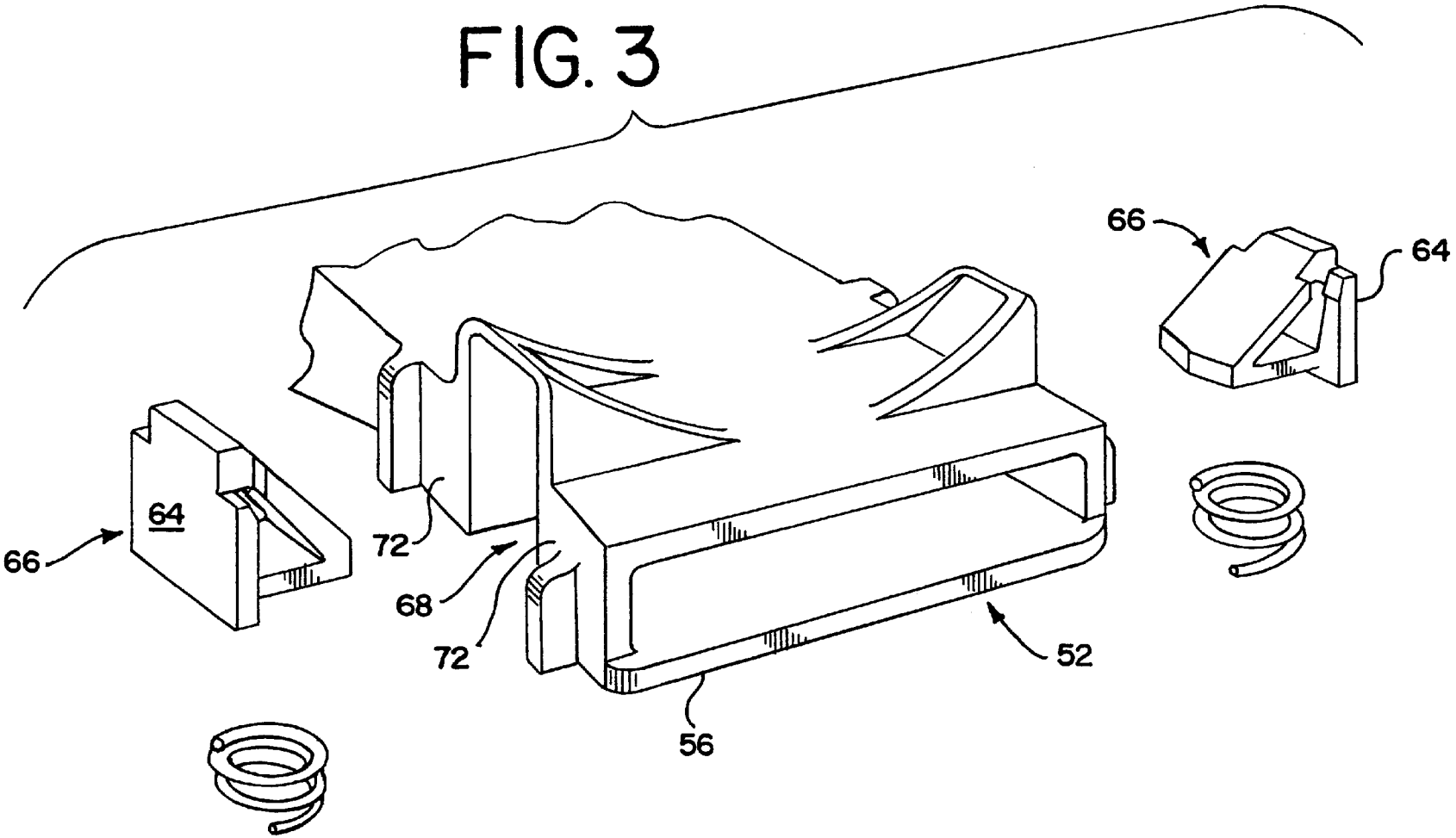
FIG. 3 is an exploded view of a truck bolster friction shoe and control spring.

Side frame columns 42 have column surfaces 12, which are the mounting locations for wear plates 10, which include rear surface 60 and front or wearing surface 62. Rear surface 60 abuts column surface 12, and wearing surface 62 is operable to contact the friction surface 64 of friction shoes 66 in FIGS. 1 and 3. Friction shoes 66 are nested and operable in friction-shoe pockets 68 in FIGS. 2 and 3.

Figure 4:
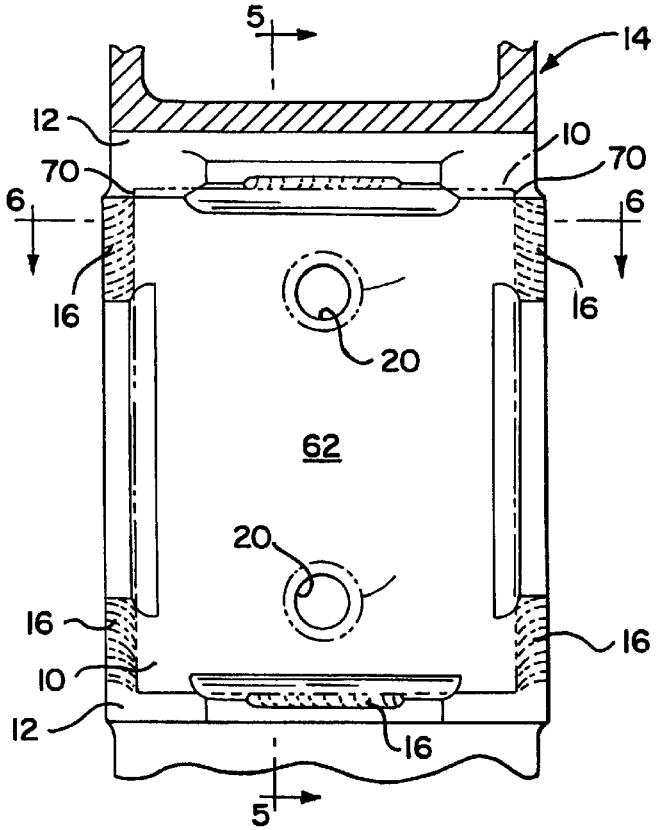
FIG. 4 is an elevational view of a side frame column with the wear plate noted in phantom outline.
Figure 5:
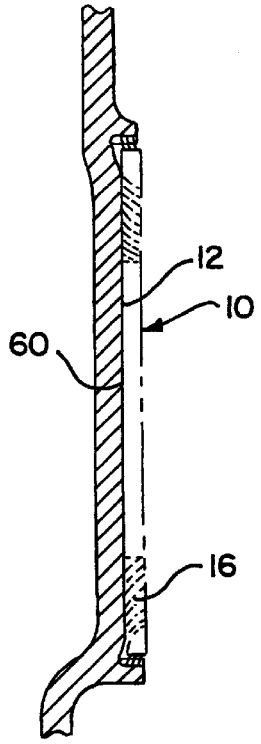
FIG. 5 is a side elevational view taken along the line 5—5 in FIG. 4.

As shown in FIGS. 4 and 5 wear plate 10 is secured to column surface 12. However, wear plate 10 in these figures has sharp or right-angled corners or vertical edges 70. During operation of truck assembly 30, wear plate 10 is operable to engage friction surface 64 shown in FIG. 3. In this figure, bolster lands 72 are also exposed to column surface 12 and wear plate 10. Thus, any twisting action between bolster 52 and either of side frames 14 and 15 may potentially expose bolster lands 72 to direct contact with vertical edges 70 at a stressed condition. This contact during operation of a railcar can result in scoring and gouging of lands 72. The ultimate consequence of continuous marring of bolster surface 72 may result in replacement of the bolster or removal of the bolster for repair, resurfacing or reconstruction.

Figure 6:
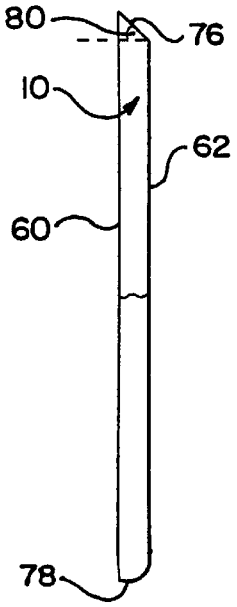
FIG. 6 is a plan view noting a wear plate having one vertical corner relief rounded and a second vertical corner relief as a chamfer at an angle; and, FIG. 7 is an oblique view of an exemplary railcar truck assembly.

The present invention provides wear plates 10 with corners having broken edges, as illustrated in FIG. 6. In this figure wear plate 10 is noted in plan view with alternative embodiments of corner breaks 76 and 78. First corner 76 is provided with a chamfer at angle 80, which is shown at and may be between about 40° and 50°, between wearing surface 62 and rear or mounting surface 60. Alternatively, second corner 78 is noted as a rounded corner or shoulder between wearing surface 62 and mounting surface. Either of these preferred embodiments would allow deflection between side frames 14 or 15 and bolster 52 without exposing bolster lands 72 to gouging or scoring.

While the invention has been described in connection with certain embodiments, it is understood that this is by way of illustration and not by way of limitation. The scope of the appended claims should be construed as broadly as the prior art will permit.

I claim:

1. A wear plate for a railway truck side frame of a railway truck assembly, said assembly having at least one side-frame and a bolster, said bolster having a first end and a second end, each said first and second end having a forward bolster land and a rear bolster land, each said side frame having a forward column surface and a rearward column surface, each said forward column surface and rearward column surface in facing alignment with a respective one of said first and second end forward bolster land and rear bolster land, each said forward column surface and said rearward column surface having a wear plate mounted thereon, each said wear plate comprising:

a forward surface, a back surface and a sidewall therebetween, each said wear plate having a generally rectangular shape, each said wear-plate forward surface and wear-plate rearward surface intersecting said sidewall at about a right angle to form a corner at the intersection of each said forward surface and rearward surface with said sidewall;

means for securing said wear plates to said forward and rearward column surfaces;

said wear plates mountable on said forward column surface and said rearward column surface by said securing means with said with said back surface contacting said respective forward and rearward column surfaces;

each said mounted wear plate having a generally vertical inner corner intersection and a generally vertical outer corner intersection of said wear plate forward surface with said sidewall;

each said forward surface vertical inner corner and outer corner having a relief along said vertical corner to avoid sharp-angle contact of said corner with said facing bolster land during operation of said railway truck assembly, said relief being one of a radius and a chamfer angle.

2. A wear plate for a railway truck side frame as claimed in claim 1 wherein said radius is approximately thirty thousandth inch.

3. A wear plate for a railway truck side frame as claimed in claim 1 wherein said chamfer angle is approximately 45°.

4. A wear plate for a railway truck side frame as claimed in claim 1 wherein said chamfer angle is between approximately 40° and 50°.

* * * * *